US005701874A

United States Patent [19]

Sari et al.

[11] Patent Number: 5,701,874

[45] Date of Patent: Dec. 30, 1997

[54] BALANCED VALVE CONTROL MEMBER FOR EXHAUST GAS RECYCLING

[75] Inventors: Osman Sari, Gravenbroich; Helmut Blank, Bornheim, both of Germany

[73] Assignee: Pierburg AG, Dusseldorf, Germany

[21] Appl. No.: 633,890

[22] Filed: Apr. 17, 1996

[30] Foreign Application Priority Data

Apr. 25, 1995 [DE] Germany ..... 295 06 928.7

[51] Int. Cl.[6] ..... F02M 25/07

[52] U.S. Cl. ..... 123/571; 251/129.07; 60/605.2

[58] Field of Search ..... 123/568, 569, 123/571; 60/605.2; 251/282, 129.07

[56] References Cited

U.S. PATENT DOCUMENTS

| | | | |
|---|---|---|---|
| 3,799,131 | 3/1974 | Bolton | 123/568 |
| 4,662,604 | 5/1987 | Cook | 123/568 |
| 4,852,853 | 8/1989 | Toshio et al. | 251/129.07 |
| 4,909,440 | 3/1990 | Mitsuyasu et al. | 251/129.07 |
| 5,255,659 | 10/1993 | Choma | 123/568 |
| 5,333,456 | 8/1994 | Bollinger | 123/568 |
| 5,497,975 | 3/1996 | Achmad | 251/129.07 |
| 5,511,531 | 4/1996 | Cook et al. | 123/568 |

FOREIGN PATENT DOCUMENTS

| | | |
|---|---|---|
| 7227371 | 3/1973 | France . |
| 4204434 | 8/1993 | Germany . |
| 4410487 | 3/1995 | Germany . |
| 2250801 | 6/1992 | United Kingdom . |

*Primary Examiner*—Willis R. Wolfe
*Attorney, Agent, or Firm*—Ladas & Parry

[57] ABSTRACT

A control valve for the recycling of exhaust gas from an exhaust gas channel to an air inlet channel of the engine, wherein a valve member of the valve opens and closes a valve opening between the exhaust gas channel and the air inlet channel. An electromagnetic control unit acts on the valve member to open the valve and a spring biasses the valve to a closed state. The valve member has a closure portion for closing the valve and is formed with a balancing section spaced from the closure portion and formed with a cross-sectional area equal to that of the closure portion so that the air pressure in the inlet channel applies equal and opposite forces on the balancing section and the closure portion whereby the valve is balanced and not subject to pressure variations in the air inlet channel, such as due to turbocharging.

5 Claims, 1 Drawing Sheet

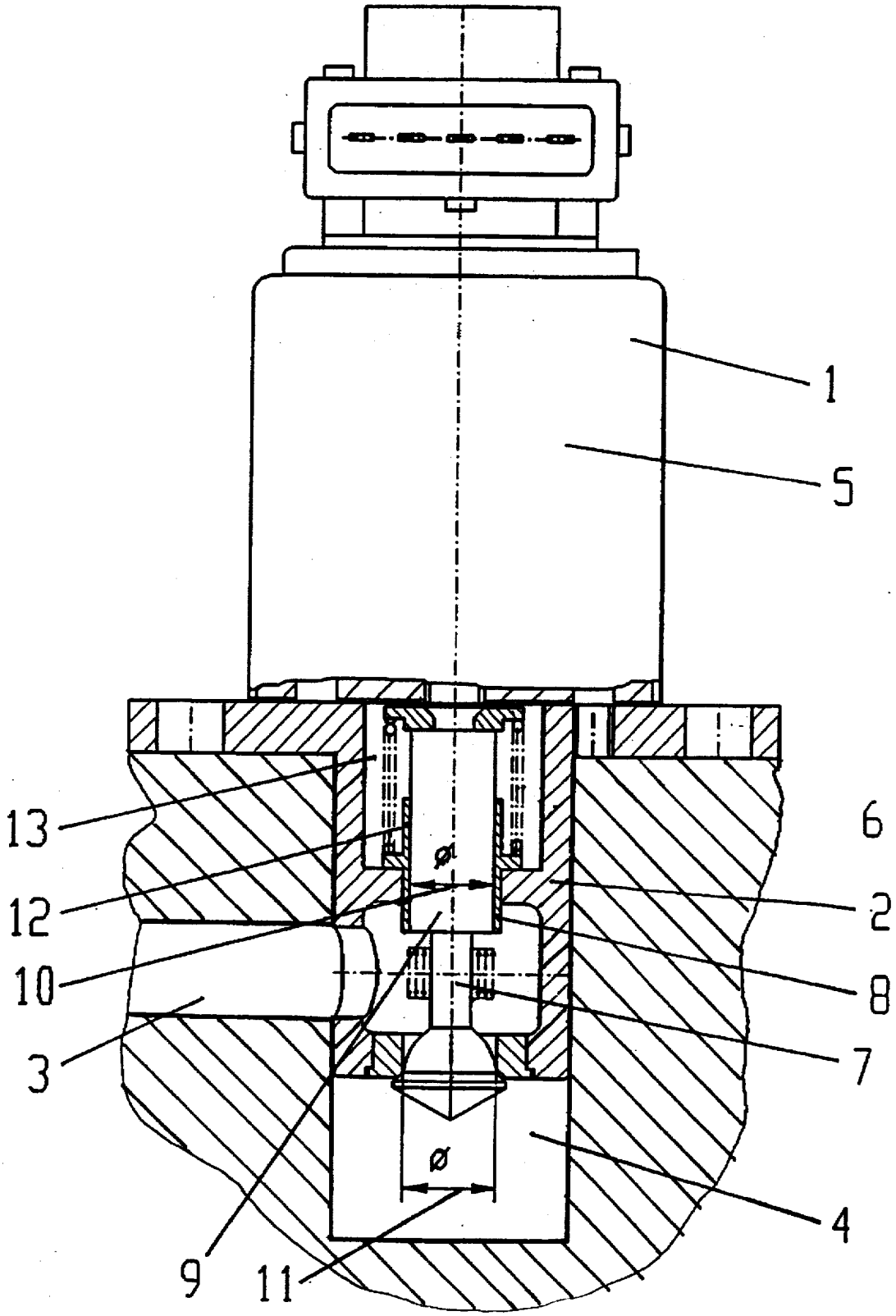
1
5
13
12
10
3
6
2
8
7
4
9
11
ø
ø

BALANCED VALVE CONTROL MEMBER FOR EXHAUST GAS RECYCLING

FIELD OF THE INVENTION

The invention relates to the construction of a control valve for use in the recycling of exhaust gases to an internal combustion engine.

Such valves control flow of recycled exhaust gases to the engine.

BACKGROUND AND PRIOR ART

Such a control valve is disclosed in German application DE 42 04 434. However, when this control valve is used in internal combustion engines which are turbocharged, the pressure pulsations produced by the turbocharger produce opening of the control valve when exhaust gas recycling is not intended. In this control valve, the exhaust gas channel and the air inlet are in communication with a common chamber of the control valve and a valve member controls the recycling of the exhaust gases and the air to the engine.

SUMMARY OF THE INVENTION

An object of the invention is to provide a control valve which controls recycling of exhaust gases to an internal combustion engine which is not subject to pressure pulsations and which can be utilized for turbocharged engines especially having high turbocharging.

The above and further objects of the invention are achieved by a construction of a control valve having a closure portion and a balancing section which are subject to air inlet pressure of the engine, said closure portion and said balancing section having equal cross-sectional areas so that opposed forces are produced on the valve member to balance the valve member. Thereby, the valve member is closed under the action of a biassing spring and remains closed until the valve member is opened by electromagnetic control means. Accordingly, there is no tendency of the valve member to open, irrespective of said inlet pressure as, for example, under pressure developed during a high turbocharging operation.

In further accordance with the invention, the closure portion and balancing section are exposed to said inlet pressure in an inlet chamber formed in the valve member, and outside said inlet chamber, the valve member is at ambient atmospheric pressure.

BRIEF DESCRIPTION OF THE DRAWING

The sole FIGURE of the drawing shows a partial sectional view of a control valve according to the invention.

DETAILED DESCRIPTION OF A PREFERRED EMBODIMENT

With reference to the drawing, therein is seen a control valve 1 used for recycling of exhaust gases to an internal combustion engine E.

The control valve includes a casing 2 which is inserted into a bore 2' provided in the engine E. The control valve 1 controls communication between an air inlet channel 3 and a channel 4 leading to the exhaust gas system of the engine.

An electromagnetic control unit 5 of the control valve 1 is secured to casing 2 and acts to open the valve 1 against the opposition of a biassing spring 6 when exhaust gases are to be recycled to the engine.

The valve 1 includes a valve member 20 slidably mounted in a guide member 8 for being opened and closed by the action of the electromagnetic control means 5 and the biassing spring 6. The valve member 20 is formed with a rod section 7 connected at its upper end to a balancing section 9 slidable in guide member 8 and at its lower end to a valve closure element 12. The rod section 7, balancing section 9 and closure element 12 are exposed in a lower chamber 14 formed in casing 2. The lower chamber 14 is in communication with inlet channel 3 so that chamber 14 is at the pressure of the air in the inlet channel 3. The balancing section 9 and the valve closure element 12 have respective cross-sectional areas 10 and 11 which are substantially equal and greater than the cross-sectional area of rod section 7. Accordingly, the forces acting on balancing section 9 and closure element 12 due to the pressure in chamber 14 are substantially equal so that the forces acting on the valve member 20 will be equilibrated and the valve member will remain balanced by the pressure irrespective of its magnitude or variations thereof. The casing 2 is formed with an upper chamber 13 which is separated from chamber 14 by a wall 15 provided with a bore in which the guide member 8 is secured. The chamber 13 contains the biassing spring 6 and is at ambient atmospheric pressure whereby the valve member 20 remains balanced and not subject to forces due to air inlet pressure.

Accordingly, the pressure in the air inlet system, which can vary substantially due to the action of a turbocharger, has no effect on the opening and closing of the valve 1. The valve 1 is simple in construction and easy to manufacture and is especially suitable for substantial inlet pressure variation especially for high turbocharging operation.

Although the invention is disclosed with reference to a particular embodiment thereof, it will become apparent to those skilled in the art that numerous modifications and variations can be made which will fall within the scope and spirit of the invention as defined by the attached claims.

What is claimed is:

1. A control valve for the recycling of exhaust gas to an internal combustion engine in which the valve controls flow of the exhaust gases from an exhaust gas channel to an air inlet channel of the engine, said control valve comprising a valve member for opening and closing a valve opening between the exhaust gas channel and the air inlet channel, electromagnetic control means acting on said valve member to open said valve opening, spring means biassing said valve member to close said valve opening, a chamber communicating with said air inlet channel, said valve member including a closure portion for closing said valve opening, said valve member further including a balancing section spaced from said closure portion, said closure portion and said balancing section being exposed in said chamber to the air pressure in said inlet channel and being opposed to one another so that forces developed by pressure of the air in said air inlet channel acts on said valve member in opposite directions to balance said valve member.

2. A control valve as claimed in claim 1, wherein said balancing section and said closure portion of said valve member have surfaces exposed in said chamber which have substantially equal areas to equilibrate the forces acting on said valve member.

3. A control valve as claimed in claim 2, wherein said control valve further comprises a further chamber containing said biassing means, said further chamber being at atmospheric pressure.

4. A control valve as claimed in claim 3, wherein said control valve further comprises a casing insertable into a bore of the engine, said casing being provided with said chamber which communicates with said air inlet channel and with said further chamber, said casing including a wall separating said chambers, said balancing section of said valve member passing through a bore provided in said wall, said valve member including a rod portion connecting said valve closure portion and said balancing section, said rod having a reduced cross-section compared to said balancing section and said valve closure portion.

5. A control valve as claimed in claim 4, wherein said control valve further comprises a guide member in said bore in said wall slidably receiving said balancing section of the valve member.

* * * * *